US009425010B2

(12) United States Patent
Hentschel

(10) Patent No.: US 9,425,010 B2
(45) Date of Patent: Aug. 23, 2016

(54) FUSE FOR A MOTOR VEHICLE POWER LINE

(75) Inventor: Wolfgang Hentschel, Schopfheim (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 0 days.

(21) Appl. No.: 13/583,741

(22) PCT Filed: Jan. 25, 2011

(86) PCT No.: PCT/EP2011/050934

§ 371 (c)(1),
(2), (4) Date: Sep. 28, 2012

(87) PCT Pub. No.: WO2011/110376

PCT Pub. Date: Sep. 15, 2011

(65) Prior Publication Data

US 2013/0009745 A1 Jan. 10, 2013

(30) Foreign Application Priority Data

Mar. 11, 2010 (DE) ..... 10 2010 011 150

(51) Int. Cl.
*H01H 37/76* (2006.01)
*H01H 39/00* (2006.01)

(52) U.S. Cl.
CPC ..... *H01H 39/006* (2013.01); *H01H 2039/008* (2013.01)

(58) Field of Classification Search
CPC ..... H01H 39/006; H01H 2039/008
USPC ..... 337/157, 401, 405; 361/115; 200/61.08
See application file for complete search history.

(56) References Cited

U.S. PATENT DOCUMENTS

| | | | | | |
|---|---|---|---|---|---|
| 1,438,609 | A | * | 12/1922 | Perkins | 337/239 |
| 2,300,142 | A | * | 10/1942 | Wood | 337/164 |
| 2,400,491 | A | * | 5/1946 | Duerkob | 337/164 |
| 2,796,494 | A | * | 6/1957 | Barnes | 337/416 |
| 3,271,544 | A | * | 9/1966 | Ragan | 337/290 |
| 3,629,766 | A | * | 12/1971 | Gould, Jr. | 337/239 |
| 3,639,874 | A | * | 2/1972 | Deelman | 337/185 |

(Continued)

FOREIGN PATENT DOCUMENTS

| | | | |
|---|---|---|---|
| CN | 101151772 A | 3/2008 | H01R 13/637 |
| DE | 1118870 | 12/1961 | |

(Continued)

OTHER PUBLICATIONS

German Patent Office, Office Action, Application No. 102010011150.3-34, dated Oct. 22, 2010, 7 pages.

(Continued)

*Primary Examiner* — Anatoly Vortman
(74) *Attorney, Agent, or Firm* — Sunstein Kann Murphy & Timbers LLP

(57) ABSTRACT

Circuit breaker for motor vehicle power lines, having a first planar connection flap, a second connection flap and a connection portion which electrically connects the connection flaps and which forms a desired breaking location. A particularly simple production with low material use can be achieved by the connection flaps and the electrical connection portion closing an explosion chamber of a pyrotechnical igniter in such a manner that the desired breaking location bursts owing to the gas pressure of the pyrotechnical igniter brought about in the event of actuation.

14 Claims, 2 Drawing Sheets

(56) References Cited

U.S. PATENT DOCUMENTS

| | | | | | |
|---|---|---|---|---|---|
| 3,779,004 | A * | 12/1973 | Gloeckler | 59/93 |
| 3,848,100 | A * | 11/1974 | Kozorezov et al. | 200/61.08 |
| 3,932,717 | A * | 1/1976 | Dike et al. | 200/61.08 |
| 4,224,487 | A * | 9/1980 | Simonsen | 200/61.08 |
| 4,385,216 | A * | 5/1983 | Cinquin | 200/61.08 |
| 4,417,519 | A * | 11/1983 | Lutz | 102/263 |
| 4,488,137 | A * | 12/1984 | Rooney et al. | 337/162 |
| 4,603,315 | A * | 7/1986 | Leong et al. | 337/243 |
| 5,097,247 | A * | 3/1992 | Doerrwaechter | 337/405 |
| 5,485,137 | A * | 1/1996 | Maleus et al. | 337/295 |
| 5,756,928 | A * | 5/1998 | Ito et al. | 149/7 |
| 5,783,987 | A * | 7/1998 | Kern et al. | 337/401 |
| 5,793,275 | A * | 8/1998 | Iversen | 337/273 |
| 5,877,563 | A * | 3/1999 | Krappel et al. | 307/10.1 |
| 5,990,572 | A * | 11/1999 | Yasukuni et al. | 307/10.1 |
| 6,404,322 | B1 * | 6/2002 | Ruegsegger et al. | 337/416 |
| 6,411,190 | B1 * | 6/2002 | Yamaguchi et al. | 337/401 |
| 6,448,884 | B1 * | 9/2002 | Yamaguchi et al. | 337/401 |
| 6,452,475 | B1 * | 9/2002 | Kawazu et al. | 337/290 |
| 6,483,420 | B1 * | 11/2002 | Takahashi et al. | 337/401 |
| 6,496,098 | B1 * | 12/2002 | Kern et al. | 337/401 |
| 6,556,119 | B1 | 4/2003 | Lell | 337/157 |
| 6,671,155 | B2 * | 12/2003 | Bennett et al. | 361/118 |
| 6,954,132 | B2 * | 10/2005 | Lell et al. | 337/30 |
| 7,078,635 | B2 * | 7/2006 | Kordel et al. | 200/61.08 |
| 7,222,561 | B2 * | 5/2007 | Brede et al. | 83/639.4 |
| 7,511,600 | B2 * | 3/2009 | Von Behr et al. | 337/157 |
| 7,639,114 | B2 * | 12/2009 | Yu | 337/405 |
| 8,432,246 | B2 * | 4/2013 | Suzuki et al. | 337/157 |
| 2001/0015883 | A1 * | 8/2001 | Nakamura et al. | 361/170 |
| 2004/0041682 | A1 * | 3/2004 | Pasha et al. | 337/401 |
| 2004/0113745 | A1 * | 6/2004 | Lell et al. | 337/157 |
| 2005/0083164 | A1 * | 4/2005 | Caruso et al. | 337/157 |
| 2005/0083165 | A1 * | 4/2005 | Tirmizi | 337/157 |
| 2006/0049027 | A1 * | 3/2006 | Iversen | 200/61.8 |
| 2006/0145808 | A1 * | 7/2006 | Von Behr et al. | 337/401 |
| 2008/0137253 | A1 | 6/2008 | George et al. | 361/93.1 |
| 2010/0328014 | A1 | 12/2010 | Suzuki et al. | 337/30 |

FOREIGN PATENT DOCUMENTS

| | | |
|---|---|---|
| DE | 19817133 | 10/1999 |
| DE | 10209627 | 10/2003 |
| DE | 102006032605 | 11/2007 |
| JP | 2000149747 | 5/2000 |
| WO | WO 2007/134875 | 11/2007 |

OTHER PUBLICATIONS

International Searching Authority, International Search Report—International Application No. PCT/EP2011/050934, dated May 9, 2011, 10 pages.

* cited by examiner

FUSE FOR A MOTOR VEHICLE POWER LINE

TECHNICAL FIELD

The subject-matter relates to a circuit breaker for motor vehicle power lines, in particular having a connection portion which is formed with connection flaps and which can be pyrotechnically separated.

BACKGROUND ART

Pyrotechnical fuses are well known in automotive technology. In particular, European Patent Application EP 0 665 566 A1 discloses an electrical safety switch which can be actuated using pyrotechnical means. The safety switch is actuated in such a manner that a propelling charge acts on a movably arranged contact portion and, owing to the movement of the contact portion, it is moved out of engagement with another contact portion in order to interrupt the electrical path. In the solution set out in this example, a piston is always guided in a sleeve. The piston is driven out of the sleeve by a pyrotechnical propelling means. The safety switch described is complex in terms of production and consequently cost-intensive.

From the German Utility Model DE 203 17 189 U1, there is also known an electrical safety switch which can be actuated in a pyrotechnical manner. In this switch, an electrical member has a predetermined separation region which can be separated into two conductor portions. It is proposed that the desired separation region has a hollow space in which the pyrotechnical igniter is fitted. During ignition, the predetermined separation region is separated by means of the pyrotechnical igniter.

From U.S. Pat. No. 7,511,600 B2, there is known an electrical safety switch which can be separated by means of a pyrotechnical separation unit. In this safety switch, a piston is accelerated onto a predetermined breaking location in such a manner that the piston breaks through the predetermined breaking location.

All the electrical safety switches described above are structurally complex to produce. Furthermore, the use of material is high so that the costs of such a safety switch are high.

For this reason, the object of the subject-matter is to provide a circuit breaker for motor vehicle power lines which is structurally simple in terms of production and which can be produced with little material usage.

SUMMARY OF THE EMBODIMENTS

This object is achieved in terms of the subject-matter by a circuit breaker for motor vehicle power lines having a first preferably planar connection flap, a second preferably planar connection flap, a connection portion which electrically connects the connection flaps and which forms a predetermined breaking location, the connection flaps and the electrical connection portion closing an explosion chamber of a pyrotechnical igniter in such a manner that the predetermined breaking location bursts owing to the gas pressure of the pyrotechnical igniter brought about in the event of actuation.

It has been recognised that, owing to the use of preferably planar connection flaps, particularly cost-effective production of a safety switch is possible. Between the connection flaps there must be arranged only a connection portion which is configured to burst when the pyrotechnical igniter is actuated. To this end, a predetermined breaking location is provided in the connection portion, or the predetermined breaking location is formed by the connection portion, wherein the predetermined breaking location bursts owing to the gas pressure of the pyrotechnical igniter. In order to maintain the gas pressure at a high level, the connection flaps themselves close the housing in which the pyrotechnical igniter is arranged. That is to say, the connection flaps perform two functions. On the one hand, the connection flaps are configured to form an electrical path which is interrupted in the event of actuation. On the other hand, the connection flaps serve to seal the housing directly so that the pyrotechnical igniter can apply sufficiently high gas pressure to the connection flaps or to the connection portion in the event of actuation.

According to an embodiment, it is proposed that the connection portion be formed from a solder material. In this instance, the connection flaps only have to be soldered to each other. This can be carried out, for example, by way of a continuous soldering step. For example, the connection flaps may be punched and directly afterwards be directed through a soldering oven in which the solder material flows into the gap formed between the connection flaps and closes this gap and consequently at the same time forms an electrical path between the connection flaps and mechanically connects the connection flaps to each other.

According to an embodiment, it is therefore proposed that the connection portion be arranged in a gap which is formed between the connection flaps. The gap is formed in particular when the connection flaps are produced, for example, when they are punched. During punching, a gap may be formed which has a width of 1 mm or less.

It is also proposed that, during the punching operation, connection webs, preferably at both sides of the gap, remain between the connection flaps. The connection webs may be formed, for example, during the punching operation, in such a manner that they protrude from the surface which is defined between the connection flaps. These connection webs can firstly be used to leave the connection flaps in one piece. The connection webs may also extend parallel with each other along the outer peripheral line of the connection flaps, without protruding from the surface defined between the connection flaps. Then, by means of appropriate guiding of the punching tools, the gap may be reduced by the connection flaps being pressed towards each other and the connection webs consequently being plastically deformed. In this instance, the connection webs are further pressed out of the surface defined between the connection flaps so that they protrude from the connection flaps. The webs lead to the gap remaining at the predetermined size and the connection webs no longer moving away from each other. After the gap has been closed, for example, by galvanization or by means of soldering, the connection flaps can be removed, for example, by means of milling.

According to an embodiment, it is proposed that the gap extend transversely relative to the extension direction of the connection flaps. In this example, the force necessary to separate the predetermined breaking location is small and/or the separation reliability is also increased since tilting of the connection flaps cannot occur at the predetermined breaking location.

It is also proposed that the connection flaps engage with each other in the region of the gap in such a manner that the connection flaps close the gap. A positive-locking (form fit) connection for receiving tensile forces is preferably formed thereby. The connection flaps preferably engage one in the other in such a manner that they can receive a tensile force. In this instance, it is preferable for the connection flaps to be positionally stable relative to each other in the event of a tensile force acting on them.

It is also proposed that the connection flaps be of dovetail-like form or folded in the region of the gap. In the case of a dovetail-like form of the gap, owing to the shape itself, a positive-locking connection is already obtained at least in one movement direction between the connection flaps. A fold can be configured in such a manner that the connection flaps engage one in the other in a hook-like manner. It is thus possible for a first connection flap to be bent in such a manner that the end of the first connection flap faces in the direction of the first connection flap and for a second connection flap to be bent in such a manner that the end of the second connection flap faces in the direction of the second connection flap. These two ends may engage one in the other and consequently secure the connection flaps relative to each other.

In order to connect the connection flaps to each other, it is proposed that the connection portion be a material which is applied by electroplating and which closes the gap electrically. After the punching operation, a gap is formed between the connection flaps. This gap may be bridged in this instance by means of connection webs. The gap is preferably less than 50 μm, particularly preferably less than 20 μm wide. In this instance, in an electroplating coating operation, the gap is closed electrically and mechanically by means of the coating material, which means that the coating material fills the gap. Subsequently, any connection webs still remaining can be removed, in particular by means of milling along the long edges of the connection flaps. The connection flaps are then connected to each other electrically and mechanically only by means of the electroplating coating material.

In order to increase the actuation reliability, it is also proposed that the connection flaps be inclined so as to face away from the igniter. A tapering firing channel is thus formed in the direction of the predetermined breaking location.

According to an embodiment, the connection flaps have members which are inclined in such a manner that the members define a triangle or a semi-circle.

In order to further increase the probability of the predetermined breaking location bursting in the event of actuation, it is proposed that the connection flaps be notched at bending edges and/or have an embossed groove. The notching at the bending edges brings about a material weakening so that a clearly defined bending edge is produced. The groove also brings about a clearly defined bending line.

According to an embodiment, it is also proposed that the connection flaps close an opening of a housing in such a manner that the connection portion is arranged in the area of the opening. As already explained in the introduction, the connection flaps seal the housing. In order to now separate the connection flaps electrically by means of the gas pressure of the igniter, it is proposed that the connection portion be arranged in the area of the opening.

According to an embodiment, it is proposed that the opening form a mouth of a firing channel of the igniter.

Finally, it is proposed that the connection flaps be adhesively bonded to the housing. It is also possible for the connection flaps to be connected to the housing by means of a friction welding process. The housing is preferably of plastics material. The walls of the housing are preferably reinforced in the region of the firing channel in such a manner that the walls withstand a higher pressure than the connection portion.

It is also proposed that the predefined breaking location in the connection portion be formed by means of an embossed groove or an embossed perforation. Both the groove and the perforation may contribute to the breaking location extending in a defined manner along the predefined breaking location in the event of actuation of the pyrotechnical igniter.

BRIEF DESCRIPTION OF THE DRAWINGS

The subject-matter is explained in greater detail below with reference to drawings which illustrate exemplary embodiments and in which.

DETAILED DESCRIPTION OF SPECIFIC EMBODIMENTS

Figure 1:
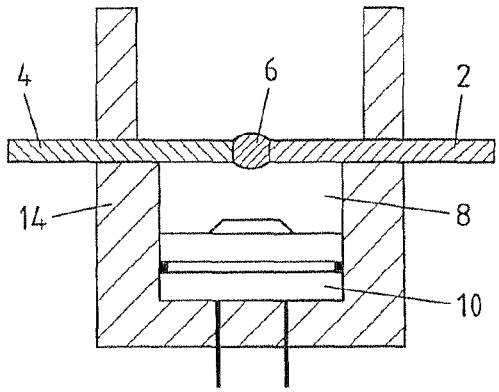
FIG. 1 is a sectioned view through a circuit breaker according to one embodiment in the inactive state.

FIG. 1 illustrates two connection flaps 2, 4 which are formed as planar portions. The connection flaps 2, 4 are spaced apart from each other so that a connection portion 6, in the case illustrated a soft solder, may be arranged in a gap 18 between the connection flaps 2, 4. The connection portion 6 connects the connection flaps 2, 4 both electrically and mechanically.

It can be seen that the connection flaps 2, 4 seal a firing channel 8 of a housing 14 of an ignition pellet 10. The housing 14 is formed from plastics material and the walls of the housing are so strong that they withstand the gas pressure of the actuated igniter 14. It can be seen that the igniter 10 can be ignited via of electrical ignition wires. An ignition pulse may, for example, be received from an airbag control device.

The connection flaps 2, 4 are adhesively bonded to the housing 14 in such a manner that they seal the firing channel 8 so that the gas pressure which occurs when the ignition pellet 10 is ignited is sufficient to separate the connection portion 6.

Figure 2:
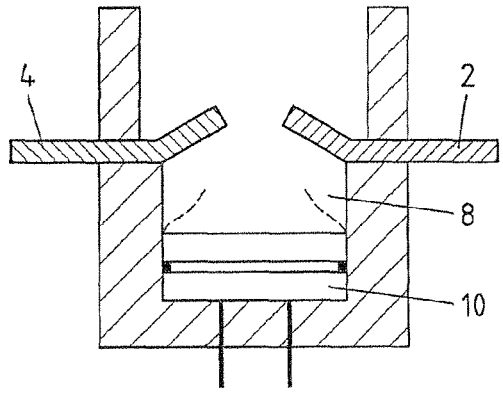
FIG. 2 is a sectioned view through a circuit breaker according to FIG. 1 in the actuated state.

The actuation operation is illustrated in FIG. 2. As can be seen, the ignition pellet 10 is ignited and the connection flaps 2, 4 are bent so as to face away from the ignition pellet 10 in the region of the firing channel 8. The connection portion 6 is broken open and the connection flaps 2, 4 are neither electrically nor mechanically connected to each other.

Figure 3:
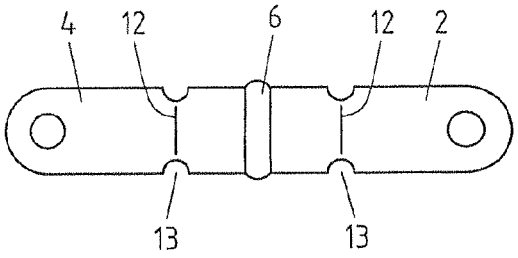
FIG. 3 is a plan view of connection flaps with a connection portion.

FIG. 3 is a plan view of two connection flaps 2, 4 according to one embodiment. It can be seen that the connection flaps 2, 4 are each provided with a groove 12. The groove 12 serves to define a bending line. It is thereby clearly defined along which line the connection flaps 2, 4 are bent in the event of actuation so that the connection portion 6 bursts. In the case illustrated, the connection portion 6 is also formed from a soft solder.

It can further be seen that the connection flaps have notches 13 in the region of the grooves 12. The notches 13 serve to reduce the material thickness of the connection flaps 2, 4 so that they bend in the region of the notches as soon as the ignition pellet 10 is actuated.

Figure 4:
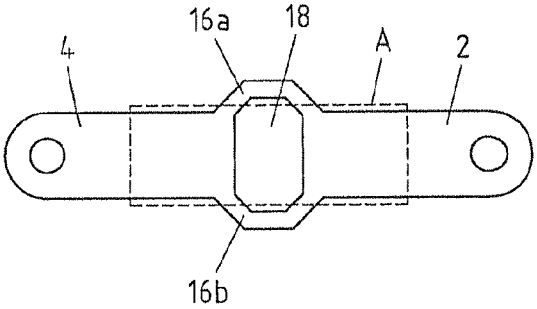
FIG. 4 is another plan view of connection flaps with a connection portion.

FIG. 4 is a plan view of two connection flaps 2, 4 in the punched state. It can be seen that the flaps 2, 4 form a gap 18 relative to each other. This gap 18 may, for example, be formed by way of punching. It can further be seen that two connection webs 16 connect the connection flaps 2, 4 to each other. The connection webs 16 may remain during the punching operation. The connection webs 16 are formed, for example, from the original planar portion.

A single flat piece is, for example, punched in a punching operation in such a manner that the connection flaps 2, 4 are still connected by means of the connection webs 16.

The connection webs 16 may be thinner than 1 mm and serve only to position the connection flaps 2, 4 relative to each other so that the gap 18 has a specific width. In the following production process, the connection flaps 2, 4 can be moved towards each other so that the connection webs 16 are pressed out of the surface A defined between the connection flaps 2, 4. The plastic deformation of the connection webs 16 results in the width of the gap 10 being able to be clearly defined. The gap 18 is reduced in this processing step, for example, to less than 50 μm, preferably less than 20 μm.

Subsequently, the connections flaps 2, 4 which are connected by means of the connection webs 16 may be subjected to an electroplating coating (galvanization) process. In the electroplating coating process, not only are the connection flaps 2, 4 mutually coated, but the gap 18 is also closed by means of the coating material. The material, for example, tin or zinc, may penetrate into the gap 18 and close it.

After the coating material has cooled, the gap 18 is closed and the coating material connects the connection flaps 2, 4 both mechanically and electrically.

Subsequently, the connection webs may be removed along the long lateral edges of the connection flaps 2, 4. This can be carried out, for example, by means of milling. The connection webs 16 are no longer required since the connection flaps 2, 4 are connected to each other by means of the material applied in the electroplating station. The connection portion 6 is consequently introduced in an electroplating manner into the gap 18, along which the predetermined breaking location extends.

Figure 5:
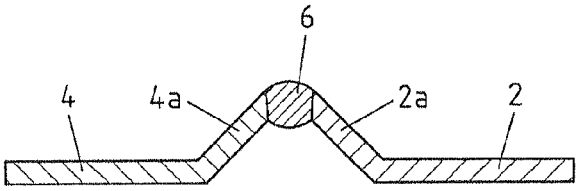
FIG. 5 is a side view of connection flaps with a connection portion.

FIG. 5 is a sectioned view through two connection flaps 2, 4 which have two members 2*a*, 4*a* which are inclined in such a manner that they face away from the ignition pellet 10 in the assembled state according to FIG. 1. The members 2*a*, 4*a* form a tapering firing channel so that the ignition energy of the ignition pellet 10 is concentrated on the connection portion 6, whereby it bursts with a higher degree of probability and actuates the fuse.

Figure 6:
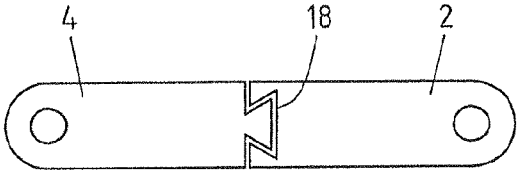
FIG. 6 is a plan view of connection flaps with a connection portion.

FIG. 6 is a plan view of connection flaps 2, 4 which form a dovetail-like gap 18 in relation to each other. This gap can also be closed mechanically and electrically by means of a chemical coating process, as set out above. It is also possible for the gap not to be of dovetail-like form but instead to allow the connection flaps to engage relative to each other in the expansion direction in another manner.

The gap may also be replaced by a perforation. The gap may also be replaced by an embossed groove.

The fuse shown can be produced in a particularly cost-effective manner with little material complexity. However, the actuation reliability is always ensured.

The invention claimed is:

1. A fuse for motor vehicle power lines comprising:

a pyrotechnical igniter having an ignition pellet contained within an explosion chamber having a firing channel extending therethrough;

a conductive first connection flap;

a conductive second connection flap spaced from the first connection flap by a gap; and a connection portion arranged in the gap which is formed between the connection flaps, the connection portion formed from solder joint and which thereby fills and bridges the gap between the connection flaps;

so as to electrically and mechanically connect the connection flaps and-forming a predetermined breaking location by the connection portion, wherein the connection flaps and the electrical connection portion sealing the explosion chamber of the pyrotechnical igniter in such a manner that the predetermined breaking location bursts owing to the gas pressure of the pyrotechnical igniter brought about in the event of actuation and wherein the connection flaps are arranged in such a manner that they are bent so as to face away from the ignition pellet in the region of the firing channel owing to the gas pressure of the pyrotechnical igniter brought about in the event of actuation.

2. The fuse according to claim 1, wherein the gap is formed by a punching operation by which the connection flaps are formed.

3. The fuse according to claim 1, wherein the gap extends transversely relative to the extension direction of the connection flaps.

4. The fuse according to claim 1, wherein the connection flaps engage one in the other in the region of the gap in such a manner that the connection flaps close the gap and/or the connection flaps are positionally stable with respect to each other in the event of a tensile force and/or the connection flaps are formed in a dovetail-like or folded manner in the region of the gap.

5. The fuse according to claim 1, wherein the connection flaps are inclined so as to face away from the igniter.

6. The fuse according to claim 5, wherein the connection flaps have members, which are inclined in such a manner that the members define a triangle or a semi-circle.

7. The fuse according to claim 5, wherein the connection flaps are notched at bending edges and/or have an embossed groove.

8. The fuse according to claim 1, wherein the connection flaps close an opening of a housing in such a manner that the connection portion is arranged in the region of the opening.

9. The fuse according to claim 8, wherein the opening forms a mouth of a firing channel of the igniter.

10. The fuse according to claim 8, wherein the connection flaps are adhesively bonded to the housing.

11. The fuse according to claim 1 wherein the predetermined breaking location in the connection portion is formed by means of an embossed groove or an embossed perforation.

12. Method for manufacturing a fuse for motor vehicle power lines according to claim 1 comprising the steps:

connecting a conductive first connection flap with a conductive second connection flap via a connection portion by means of which the connection flaps are soldered together;

arranging the linked connection flaps in such a manner that a housing is sealed by the connection flaps.

13. Method according to claim 12, wherein said first and second connection flaps are punched.

14. Method according to claim 13, wherein directly after the punching process said first and second connection flaps are directed through a soldering oven in which the soldering material flows into a gap formed between the connection flaps, closes this gap and consequently at the same time forms an electrical and mechanical connection between both connection flaps.

* * * * *